US005416951A

United States Patent [19]

Keyaki et al.

[11] Patent Number: 5,416,951

[45] Date of Patent: May 23, 1995

[54] DECORATIVE PULL TAB

[75] Inventors: Keiichi Keyaki, Kurobe; Kideyuki Matsushima; Hitomi Kawamura, both of Toyama, all of Japan

[73] Assignee: Yoshida Kogyo K.K., Tokyo, Japan

[21] Appl. No.: 170,793

[22] Filed: Dec. 21, 1993

[30] Foreign Application Priority Data

Dec. 22, 1992 [JP] Japan ..... 4-087989 U

[51] Int. Cl.[6] ..... A44B 19/00

[52] U.S. Cl. ..... 24/431; 24/429; 24/430

[58] Field of Search ..... 24/431, 430, 429, 419, 24/437, 3 K, 116 A

[56] References Cited

U.S. PATENT DOCUMENTS

| | | | |
|---|---|---|---|
| 1,302,606 | 5/1919 | Sundback | 24/429 |
| 1,539,220 | 5/1925 | Taylor | 24/3 K |
| 2,103,036 | 12/1937 | Marinsky | 24/429 |
| 2,145,118 | 1/1939 | Knoess | 24/431 |
| 2,214,448 | 9/1940 | Belcher, Jr. . | |
| 2,246,091 | 6/1941 | Forstner | 24/3 K |
| 2,302,741 | 11/1942 | Carille . | |
| 3,641,634 | 2/1972 | Asai | 24/429 |
| 4,935,997 | 6/1990 | Hirsch | 24/668 |
| 5,083,349 | 1/1992 | Axtell | 24/430 |
| 5,090,096 | 2/1992 | Terada et al. | 24/431 |
| 5,136,756 | 8/1992 | Krauss . | |

FOREIGN PATENT DOCUMENTS

| | | | |
|---|---|---|---|
| 1015372 | 9/1952 | France . | |
| 59-2210 | 1/1984 | Japan . | |
| 59-11400 | 8/1984 | Japan . | |
| 131419 | 5/1929 | Switzerland . | |
| 0621539 | 4/1949 | United Kingdom | 24/429 |

*Primary Examiner*—Victor N. Sakran
*Attorney, Agent, or Firm*—Hill, Steadman & Simpson

[57] ABSTRACT

A decorative pull tab adapted for being pivotally connected to a slide fastener slider body and for fastening a decorative piece thereto. The decorative pull tab comprising a ring pivotally connected to the slider body and a pull tab body including a pair of first and second clamping plates and a hinge joint joining the first and second plates, the pull tab body being folded over itself on the hinge joint, with the ring pivotally connected to the hinge joint and with the decorative piece clamped between the first and second clamping plate.

8 Claims, 3 Drawing Sheets

DECORATIVE PULL TAB

BACKGROUND OF THE INVENTION

1. Field of the Invention

The present invention relates generally to a slider for slide fasteners and more particularly to a pull tab for joining thereto various decorative piece such as a decorative cord, a colored ball chain or the like.

2. Description of the Prior Art

Heretofore, usually a decorative piece such as a decorative cord, a colored ball chain or the like is fastened directly to a distal end of a pull tab pivotally attached to a slider. One typical pull tab of the type described is disclosed in Japanese Utility Model Laid-Open Publication No. 59-114008. A chain of rings has its one end fastened directly to an aperture formed in a distal end of the pull tab and has the other end provided with a small ornamental bell.

Another pull tab of this type is disclosed in Japanese Utility Model Laid-open Publication No. 59-2210. Likewise, a decorative cord has its one end fastened directly to an aperture of a distal end of the pull tab and has the other end provided with an ornamental piece.

Both pull tab has drawbacks in that, once a decorative piece is fastened to the pull tab, it is extremely difficult if not impossible to replace the decorative piece with another decorative piece.

SUMMARY OF THE INVENTION

With the foregoing difficulties in view, it is therefore an object of the present invention to provide a pull tab which can easily join a decorative piece thereto and which can have the decorative piece replaced with a new decorative piece at great ease, whenever such desire may arise later on.

According to the present invention, a decorative pull tab adapted for being pivotally connected to a slide fastener slider body and for fastening a decorative piece thereto, the decorative pull tab comprising a ring pivotally connected to the slider body and a pull tab body including a pair of first and second clamping plates and a hinge joint joining the first and second plates, the clamping pull body being folded over itself on the hinge joint, with the ring pivotally connected to the hinge joint and with the decorative piece clamped between the first and second clamping plate.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 6:
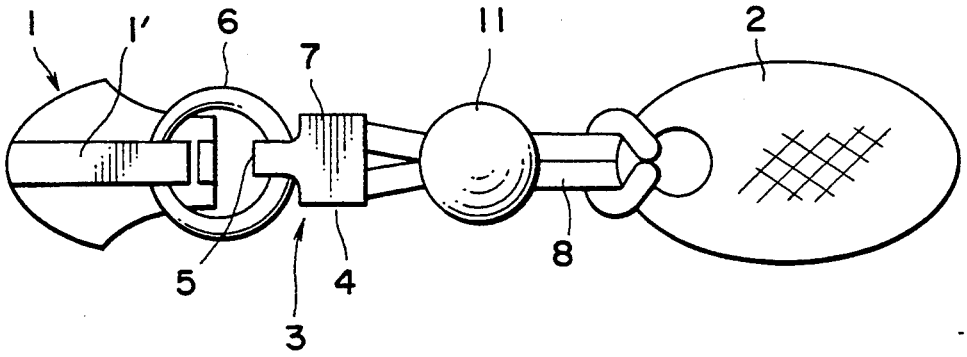
FIG. 6 is a front view of the pull tab of FIG. 1 and associated parts showing the pull tab pivotally connected to a slider body.
Figure 7:
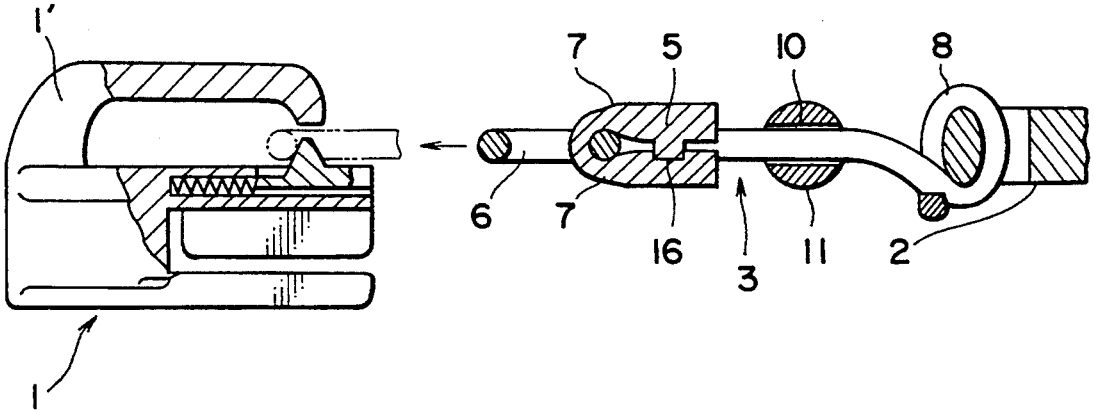
FIG. 7 is a longitudinal central cross-sectional view showing the pull tab and the associated parts of FIG. 6, before the pull tab is connected to the slider body.

Referring now to the drawings, particularly FIGS. 6 and 7, a pull tab 3 is pivotally connected to an attachment lug 1' mounted on a slider body 1 and adapted for joining a decorative cord 8 thereto.

Figure 1:
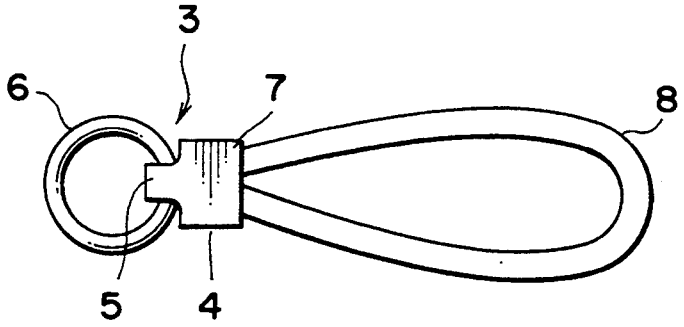
FIG. 1 is a front view of a pull tab according to the present invention showing the pull tab to join a decorative cord thereto.

As shown in FIG. 1, the pull tab 3 broadly comprises a pull tab body 4 and an attachment ring 6 pivotally connected thereto.

Figure 3:
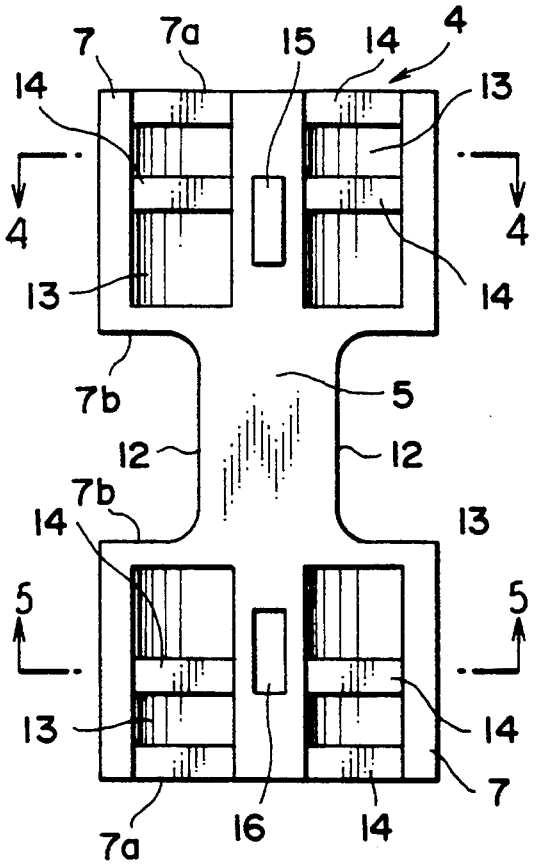
FIG. 3 is a plan view showing a clamping pull tab body of the pull tab of FIG. 1 in an unfolded state.
Figure 4:
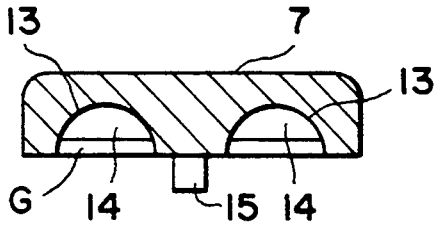
FIG. 4 is a cross-sectional view taken on line 4—4 of FIG. 3.
Figure 5:
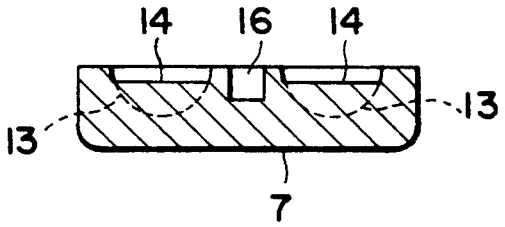
FIG. 5 is a cross-sectional view taken on line 5—5 of FIG. 3.

As shown in FIGS. 3, and 4, when unfolded, the pull tab body 4 is a flat metal strip substantially of an dumbbell-shaped profile and comprises a pair of substantially rectangular first and second clamping plates 7, 7' and a substantially rectangular hinge joint 5 connecting the first and second rectangular clamping plates 7, 7'. The hinge joints 5 is less in width than the rectangular clamping plates 7, 7' on the opposite sides thereof to define, with the opposed clamping plates 7, 7', a pair of opposed substantially rectangular recesses 12, 12. The pull tab body 4 is symmetrical relative to both a longitudinal axis and a lateral axis of thereof. Each clamping plate 7, 7' has a pair of grooves 13, 13 formed in its inner surface longitudinally of the pull tab body 4. Each groove 13 begins with the distal edge *7a* of the clamping plate 7 and falls short of the proximal edge *7b* of the clamping plate 7. A plurality of projecting teeth 14 are mounted laterally in each groove at suitable positions. Each projecting teeth 14 falls short of the inner surface of the clamping plate 7 to thus leave a gap G. Each projecting teeth 13 may have a plurality of slits formed in the top surface thereof. Furthermore, instead of provision of projecting teeth 14, each groove 13 13 may be knurled or jagged on the inner surface. Each groove 13 may be diverged toward the proximal edge *7b*.

The first clamping plate 7 has an engaging lug 15 protuberantly mounted on the inner side between the opposed grooves 13 and 13. The second clamping plate 7' has an engaging recess 16 formed in the inner side between the opposed grooves 13, 13. The engaging lug 15 of the clamping plate 7 is adapted for fitting engagement with the engaging recess 16 of the second clamping plate 7' when the pull tab body 4 is folded over itself on the hinge joint 5, as closely described hereinafter.

In assembly, first an attachment ring 6 is placed on the hinge joint 12 of the pull tab body 4. Both ends of a looped cord 8 is then inserted into the opposed grooves 13, 13 in either first or second clamping plate 7, 7'. Then, the clamping pull tab body 4 is folded over itself on the hinge joint 5 to thus bring the engaging lug 15 of the first clamping plate 7 into fitting engagement with the engaging recess 16 of the second clamping plate 7'. As a result, an attachment ring 6 is pivotally connected with the hinge joint 5 of the pull tab body 4, and at the same time, the projecting teeth 14 of the pull tab body 4 come into biting engagement with the ends of the cord 8, so that the cord 8 is securely fastened to the pull tab body 4. Then, the pull tab 3 is pivotally connected to the slider body 1 by fitting the attachment ring 6 into the attachment lug 1' of the slider body 1, as indicated in FIG. 7. Alternatively, the cord 8 may be fastened to the pull tab body 4 after the pull tab 3 has ben connected to the slider body 1. This has an advantage in that a consumer can replace the decorative cord 8 attached to a slider after he has purchased a garment or the like.

The engaging lug 15 and the engaging recess 16 function as a guide in folding the pull tab body 4 accurately over itself, thus bringing the first and second clamping plates 7, 7' into accurate registry with each other. The engagement of the engaging lug 15 and the engaging recess 16 helps to prevent the hinge joint 5 from deformation under stresses tending to spread the clamping plates 7, 7' apart.

Instead of the cord 8, a rubber cord, a plastic cord or a chain of miniature rings may be clamped by the clamping plates 7, 7' of the pull tab body 4.

Figure 2:
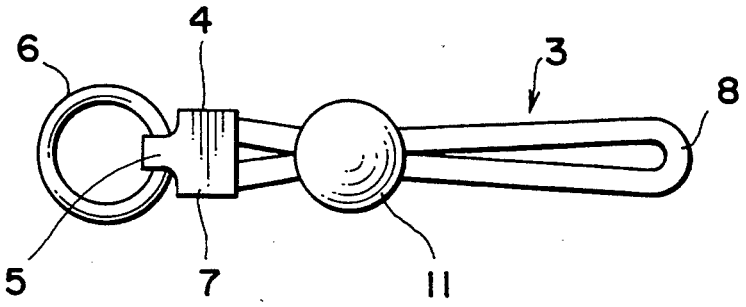
FIG. 2 is a view similar to FIG. 1 but showing the pull tab to join a balled decorative cord thereto.

As shown in FIG. 2, a balled cord 8 may be clamped by the clamping plates 7, 7' of the pull tab body 4. A small decorative ball 11 has a through opening 10 formed therethrough. The ball 11 has the folded cord 8 inserted through the through hole 10 thereof for reciprocal movement on the cord 8.

Furthermore, a decorative tab 2 may be bound to the free end of the cord 8. In this event, the cord 8 may be long enough to bind the decorative tab 2.

Figure 8:
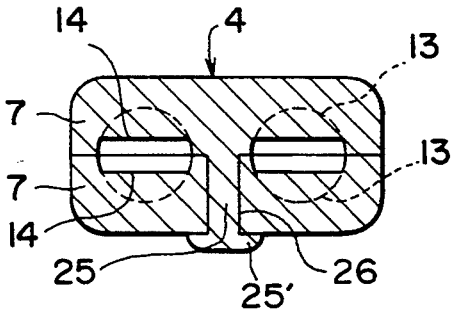
FIG. 8 is a cross-sectional view of a pull tab body according to another embodiment of the present invention.

FIG. 8 shows another embodiment of the present invention. A pull tab 3 according to this embodiment is substantially identical with the pull tab 3 according to the preceding embodiment except that, instead of the engaging recess 16 and the engaging lug 15, an engaging through aperture 26 is formed in the second clamping plate 7' and an engaging projecting stud 25 is mounted on the first clamping plate 7. The pull tab body 4 is folded over itself on the hinge joint 5 with the projecting stud 25 inserted through the engaging aperture 26. A forward part of the stud 25 exposed beyond the through aperture 26 is flattened against the outer side of the clamping plate 7'. This construction is further advantageous in preventing the first and second clamping plates 7, 7' from accidentally spread apart under more severe stresses tending to spread them apart.

With the construction of the invention set forth hereinabove, the present invention enjoys the following advantages.

The pull tab can attach any decorative piece such as a cord, a chain of rings or a decorative tag thereto at great ease.

Since the pull tab can attach any decorative piece thereto at ease, a manufacturer can meet various desires of customers in pull tab design by storing a variety of decorative pieces of various materials, sizes and colors.

Since the projecting teeth come into binding engagement with the ends of the cord, the cord can be firmly retained to the pull tab to thus being completely exempt from coming off the pull tab.

Obviously, various modifications and variations of the present invention are possible in the light of the above teaching. It is therefore to be understood that within the scope of the appended claims the invention may be practiced otherwise than as specifically described.

What is claimed is:

1. A decorative pull tab adapted for being pivotally connected to a slide fastener slider body and for fastening a decorative piece thereto, the decorative pull tab comprising a ring pivotally connected to the slider body and a pull tab body including a pair of first and second clamping plates and a hinge joint joining the first and second plates, the pull tab body being folded over itself on the hinge joint, with the ring pivotally connected to the hinge joint and with the decorative piece clamped between the first and second clamping plate.

2. A decorative pull tab according to claim 1, the decorative piece being an elongated cord folded like a loop, both ends of the cord being clamped between the first and second clamping plate.

3. A decorative pull tab according to claim 2, a decorative ball having a through hole formed therethrough, the decorative ball having the folded cord inserted through the through hole for reciprocal movement through the through hole.

4. A decorative pull tab according to claim 2, the pull tab body being a metal strip substantially of a dumbbell profile, each clamping plates being substantially rectangular, the hinge joints being less in width than the rectangular clamping plates to define, with the first and second clamping plates, a pair of opposed substantially rectangular indentations, each clamping plate including a pair of juxtaposed grooves formed in its inner surface longitudinally of the pull tab body for receiving both ends of the folded cord, and means for retaining the cord in the groove.

5. A decorative pull tab according to claim 4, the cord-retaining means comprising a projecting tooth mounted laterally in each groove at a suitable position.

6. A decorative pull tab according to claim 4, the cord-retaining means comprising jags formed in an inner surface of the groove.

7. A decorative pull tab according to claim 4, the first clamping plate having an engaging lug protuberantly mounted on the inner surface between the opposed grooves, the second clamping plate having an engaging recess formed in the inner surface between the opposed grooves for fitting engagement with the engaging lug when the pull tab body is folded over itself on the hinge joint.

8. A decorative pull tab according to claim 4, the first clamping plate having an engaging stud protuberantly mounted on an inner side between the opposed grooves, the second clamping plate having an engaging through aperture formed therethrough, the engaging stud being inserted through the engaging aperture when the clamping pull tab body is folded on the hinge joint, a forward part of the stud exposed beyond the through aperture being flattened against the outer side of the clamping plate.

* * * * *